US012296378B2

(12) United States Patent
Ahn et al.

(10) Patent No.: US 12,296,378 B2
(45) Date of Patent: May 13, 2025

(54) METHOD OF MANUFACTURING METAL PRODUCT AND MOLD USED THEREFOR

(71) Applicant: POINT ENGINEERING CO., LTD., Asan-Si (KR)

(72) Inventors: Bum Mo Ahn, Suwon-si (KR); Seung Ho Park, Hwaseong-si (KR); Sung Hyun Byun, Suwon-si (KR)

(73) Assignee: POINT ENGINEERING CO., LTD., Asan-si (KR)

( * ) Notice: Subject to any disclaimer, the term of this patent is extended or adjusted under 35 U.S.C. 154(b) by 0 days.

(21) Appl. No.: 18/674,384

(22) Filed: May 24, 2024

(65) Prior Publication Data

US 2024/0390971 A1 Nov. 28, 2024

(30) Foreign Application Priority Data

May 25, 2023 (KR) ..... 10-2023-0067766

(51) Int. Cl.
*B22C 9/06* (2006.01)
*B22C 3/00* (2006.01)

(52) U.S. Cl.
CPC ..... *B22C 9/061* (2013.01); *B22C 3/00* (2013.01)

(58) Field of Classification Search
CPC ..... B22C 9/061; B22C 3/00
See application file for complete search history.

(56) References Cited

U.S. PATENT DOCUMENTS

2005/0196644 A1* 9/2005 Itoh ..... G11B 5/39

FOREIGN PATENT DOCUMENTS

KR 10-1082459 B1 11/2011

* cited by examiner

*Primary Examiner* — Kevin P Kerns
*Assistant Examiner* — Steven S Ha

(57) ABSTRACT

Proposed are a method of manufacturing a metal product that uses an anodic aluminum oxide film and a patternable material together, in which a space where the metal product is manufactured is formed by the patternable material and the anodic aluminum oxide film provides structural support to the patternable material; and a mold using an anodic aluminum oxide film used therefor.

8 Claims, 15 Drawing Sheets

METHOD OF MANUFACTURING METAL PRODUCT AND MOLD USED THEREFOR

CROSS REFERENCE TO RELATED APPLICATION

The present application claims priority to Korean Patent Application No. 10-2023-0067766, filed May 25, 2023, the entire contents of which is incorporated herein for all purposes by this reference.

BACKGROUND OF THE INVENTION

Field of the Invention

The present disclosure relates to a method of manufacturing a metal product and a mold used therefor.

Description of the Related Art

The present disclosure relates to a method of manufacturing a metal product, a part of which has a dimensional range of several tens of μm, by using a combination of an anodic aluminum oxide film and a patternable material, and to a mold used therefor.

Hereinafter, an electrically conductive contact pin will be described as an example of the above metal product. A test for electrical characteristics of a semiconductor device is performed by approaching an inspection object (semiconductor wafer or semiconductor package) to an inspection apparatus having a plurality of electrically conductive contact pins and then bringing the electrically conductive contact pins into contact with corresponding electrode pads (or solder balls or bumps) on the inspection object. After the electrically conductive contact pins reach positions where they are brought into contact with the electrode pads on the inspection object, a process of further approaching the inspection object is performed. This process is called overdrive. Overdrive is a process that elastically deforms the electrically conductive contact pins. By overdrive, all electrically conductive contact pins can be reliably brought into contact with the electrode pads even when there is a height difference between the electrode pads or the electrically conductive contact pins. During overdrive, each electrically conductive contact pin is elastically deformed, and performs scrubbing while a tip thereof moves on an electrode pad. By such scrubbing, an oxide film on a surface of the electrode pad can be removed and contact resistance can be reduced thereby.

In the manufacture of contact pins, a method of manufacturing contact pins using laser technology is generally used. For example, there is a method of manufacturing contact pins by cutting a substrate made of a conductive material with a laser beam. The laser beam cuts the substrate along a predetermined profile corresponding to each contact pin and forms sharp edges on the contact pin through different operations. However, such laser cutting technology for manufacturing contact pins by cutting a metal sheet along a profile corresponding to the final shape of each contact pin has limitations in improving the dimensional accuracy of the contact pin. Also, since the contact pins have to be cut individually with a laser beam, a problem arises in that the production speed of the contact pins is reduced.

Meanwhile, contact pins may be manufactured using an MEMS process. A process of manufacturing a contact pin using the MEMS process involves first applying a photoresist film to a surface of a conductive substrate and then patterning the photoresist film. After that, a metal material is deposited on the exposed surface of the conductive substrate within openings by electroplating using the photoresist film as a mold, and the photoresist film and the conductive substrate are removed to obtain contact pins.

When using only a photoresist film as a mold for electroplating, it is difficult to sufficiently increase the height of the photoresist film. As disclosed in Korean Patent No. 10-1082459, in order to form a slot inside a contact pin, a photoresist film is formed on a part corresponding to the slot before electroplating, and the photoresist film is removed when plating is completed, thereby creating a slot. The slot has a very small width of several μm, but is required to have a high height of tens of μm. However, there is a limit to increasing the aspect ratio of the photoresist film formed on the part corresponding to the slot, and when the aspect ratio of the photoresist film is large, there is a problem in that deformation of the photoresist film increases the possibility that the shape of the contact pin may not be properly realized.

Additionally, in order to obtain more contact pins on a unit board, the pitch between contact pins has to be narrow. When the width of the photoresist film existing between the contact pins is reduced, the aspect ratio increases. This also causes the above-mentioned problem that deformation of the photoresist film increases the possibility that the shape of the contact pin may not be properly realized.

The foregoing is intended merely to aid in the understanding of the background of the present disclosure, and is not intended to mean that the present disclosure falls within the purview of the related art that is already known to those skilled in the art.

Documents of Related Art (Patent document 1) Korean Patent No. 10-1082459

SUMMARY OF THE INVENTION

Accordingly, the present disclosure has been made keeping in mind the above problems occurring in the related art, and an objective of the present disclosure is to provide a method of manufacturing a metal product that uses an anodic aluminum oxide film and a patternable material together, in which a space where the metal product is manufactured is formed by the patternable material and the anodic aluminum oxide film provides structural support to the patternable material; and to provide a mold using an anodic aluminum oxide film used therefor.

In order to achieve the above objective, according to one aspect of the present disclosure, there is provided a mold using an anodic aluminum oxide film, the mold including: a support mold made of the anodic aluminum oxide film and having an opening and exposed wall surfaces exposed toward the opening; and a patternable material formed on the exposed wall surfaces of the anodic aluminum oxide film and forming a space having a smaller horizontal area than the opening.

In addition, the patternable material may be formed at the same height as a height of the support mold, and the patternable material may have a width and be formed along the exposed wall surfaces.

In addition, the patternable material may cover the exposed wall surfaces of the support mold so that the exposed wall surfaces are not exposed toward the space.

In addition, the support mold may include: a main body provided around the opening; and an island provided inside the opening and spaced apart from the main body. The patternable material may cover exposed wall surfaces of the main body exposed toward the opening and exposed wall surfaces of the island exposed toward the opening.

In addition, the patternable material may be a photosensitive material.

In addition, the mold may further include: a seed layer provided under the space; and a substrate provided under the seed layer. The space may serve as a space for plating.

Meanwhile, according to another aspect of the present disclosure, there is provided a method of manufacturing a metal product, the method including: preparing a support mold made of an anodic aluminum oxide film and having an opening; forming a patternable material on exposed wall surfaces of the anodic aluminum oxide film exposed toward the opening to form a space having a smaller horizontal area than the opening; and forming a metal in the space.

In addition, the forming of the patternable material may include: filling the opening with the patternable material; and removing a part of the patternable material filled in the opening so that the space is formed inside the patternable material while the exposed wall surfaces are covered by the patternable material so as not to be exposed toward the space.

In addition, the method may further include: after the forming of the metal in the space, removing the support mold and the patternable material.

The present disclosure can provide a method of manufacturing a metal product that uses an anodic aluminum oxide film and a patternable material together, in which a space where the metal product is manufactured is formed by the patternable material and the anodic aluminum oxide film provides structural support to the patternable material; and provide a mold using an anodic aluminum oxide film used therefor.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
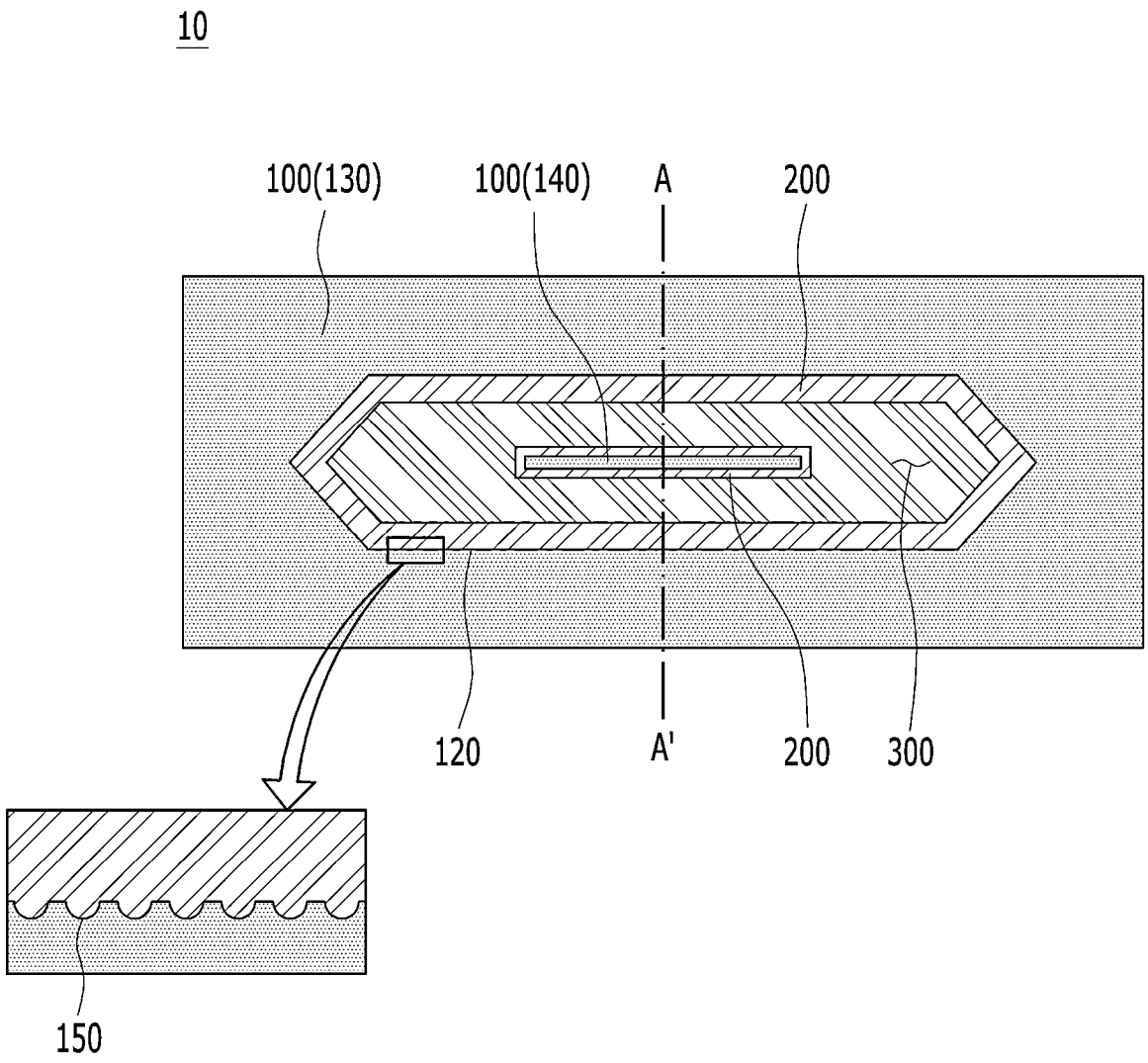
FIG. 1 is a plan view illustrating a mold using an anodic aluminum oxide film according to an exemplary embodiment of the present disclosure.

Contents of the description below merely exemplify the principle of the present disclosure. Therefore, those of ordinary skill in the art may implement the theory of the present disclosure and invent various apparatuses which are included within the concept and the scope of the present disclosure even though it is not clearly explained or illustrated in the description. Furthermore, in principle, all the conditional terms and embodiments listed in this description are clearly intended for the purpose of understanding the concept of the present disclosure, and one should understand that the present disclosure is not limited to the exemplary embodiments and the conditions.

The above described objectives, features, and advantages will be more apparent through the following detailed description related to the accompanying drawings, and thus those of ordinary skill in the art may easily implement the technical spirit of the present disclosure.

The embodiments of the present disclosure are described with reference to cross-sectional views and/or perspective views which schematically illustrate ideal embodiments of the present disclosure. For explicit and convenient description of the technical content, sizes or thicknesses of films and regions in the figures may be exaggerated. Therefore, variations from the shapes of the illustrations as a result, for example, of manufacturing techniques and/or tolerances, are to be expected. In addition, a limited number of molded products are illustrated in the drawings by way of example. Thus, the embodiments should not be construed as limited to the particular shapes of regions illustrated herein but are to include deviations in shapes that result, for example, from manufacturing.

Wherever possible, the same reference numerals will be used throughout different embodiments and the description to refer to the same or like elements or parts. In addition, the configuration and operation already described in other embodiments will be omitted for convenience.

The present disclosure relates to a method of manufacturing a metal product, a part of which has a dimensional range of several tens of μm, by using a combination of an anodic aluminum oxide film and a patternable material, and to a mold used therefor.

A metal product according to an exemplary embodiment of the present disclosure refers to an article having a predetermined thickness, height, and length. The metal product according to the exemplary embodiment of the present disclosure may be manufactured by MEMS technology, and may be applied to various fields depending on its use.

The metal product according to the exemplary embodiment of the present disclosure includes an electrically conductive contact pin for inspecting an inspection object. The electrically conductive contact pin is provided in an inspection device and is used to transmit electrical signals by making electrical and physical contact with the inspection object. The inspection device may be an inspection device used in a semiconductor manufacturing process, for example, a probe card or a test socket depending on the type of the inspection object. However, the inspection device according to the exemplary embodiment of the present disclosure is not limited thereto, and includes any device for checking whether the inspection object is defective by applying electricity.

A mold using an anodic aluminum oxide film according to an exemplary embodiment of the present disclosure may be used to manufacture a metal product. Here, the metal product may be an article that includes an electrically conductive contact pin, is made of metal, and has a predetermined thickness, height, and length.

Hereinafter, exemplary embodiments of the present disclosure will be described in detail with reference to the accompanying drawings.

Mold 10 Using Anodic Aluminum Oxide Film

Figure 2:
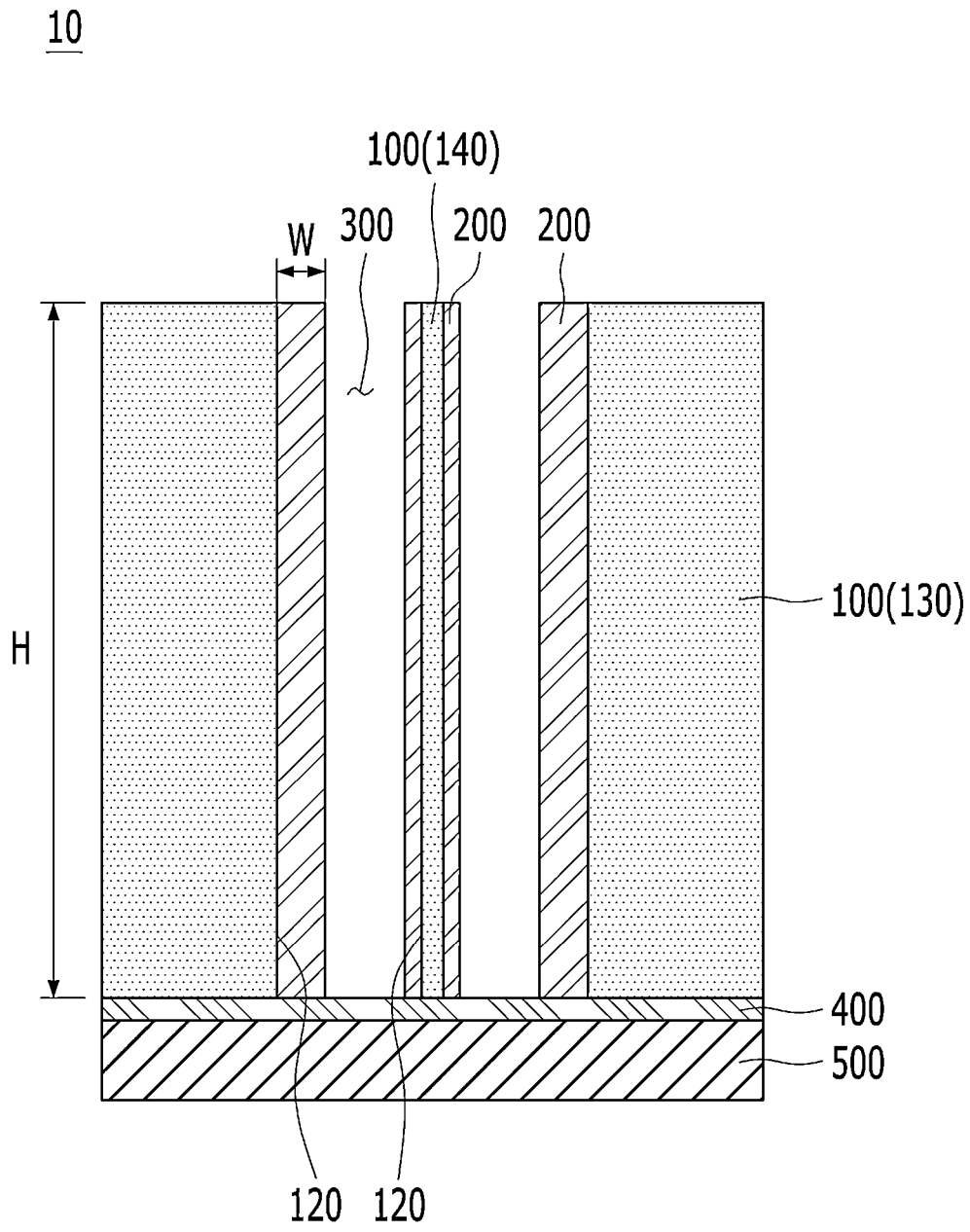
FIG. 2 is a sectional view taken along line A-A' of FIG. 1.
Figure 3:
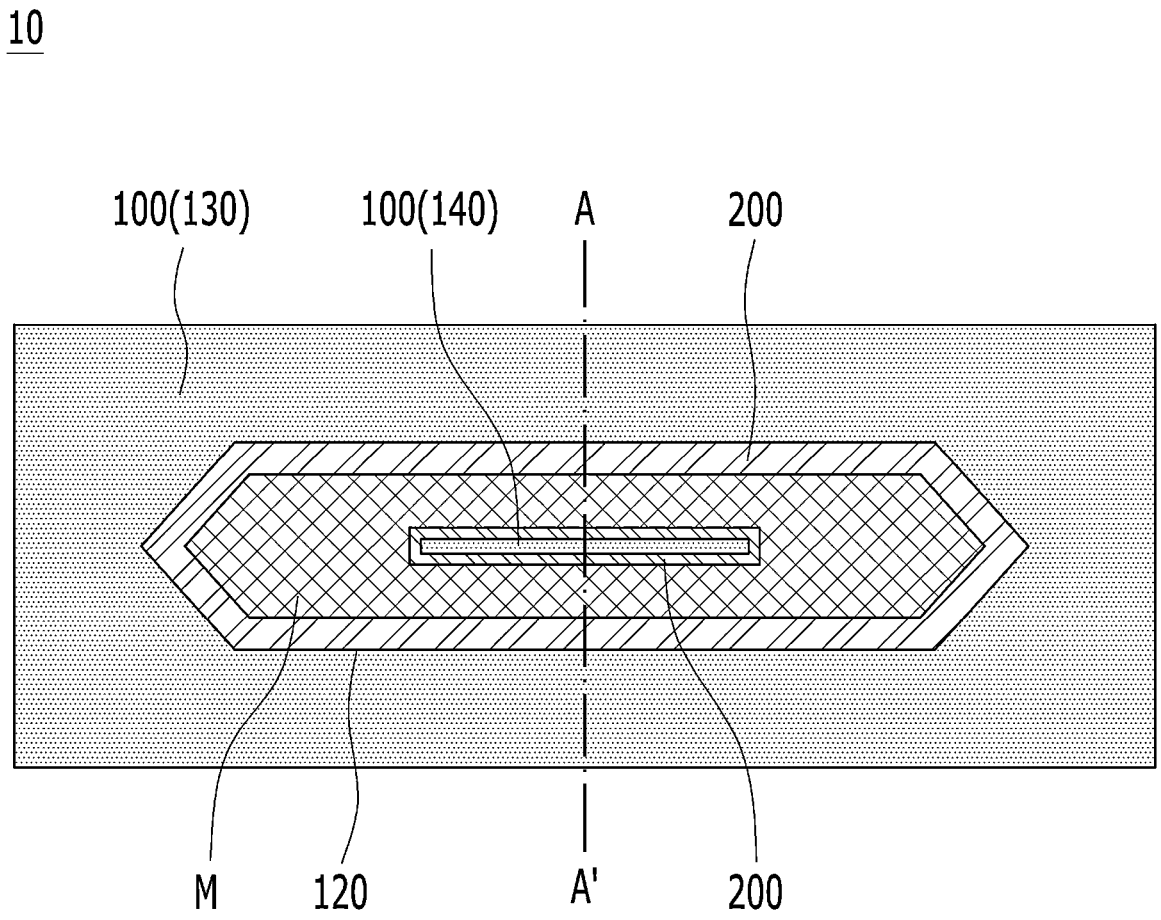
FIG. 3 is a view illustrating a state in which a metal is filled in a space of the mold using the anodic aluminum oxide film according to the exemplary embodiment of the present disclosure.
Figure 4:
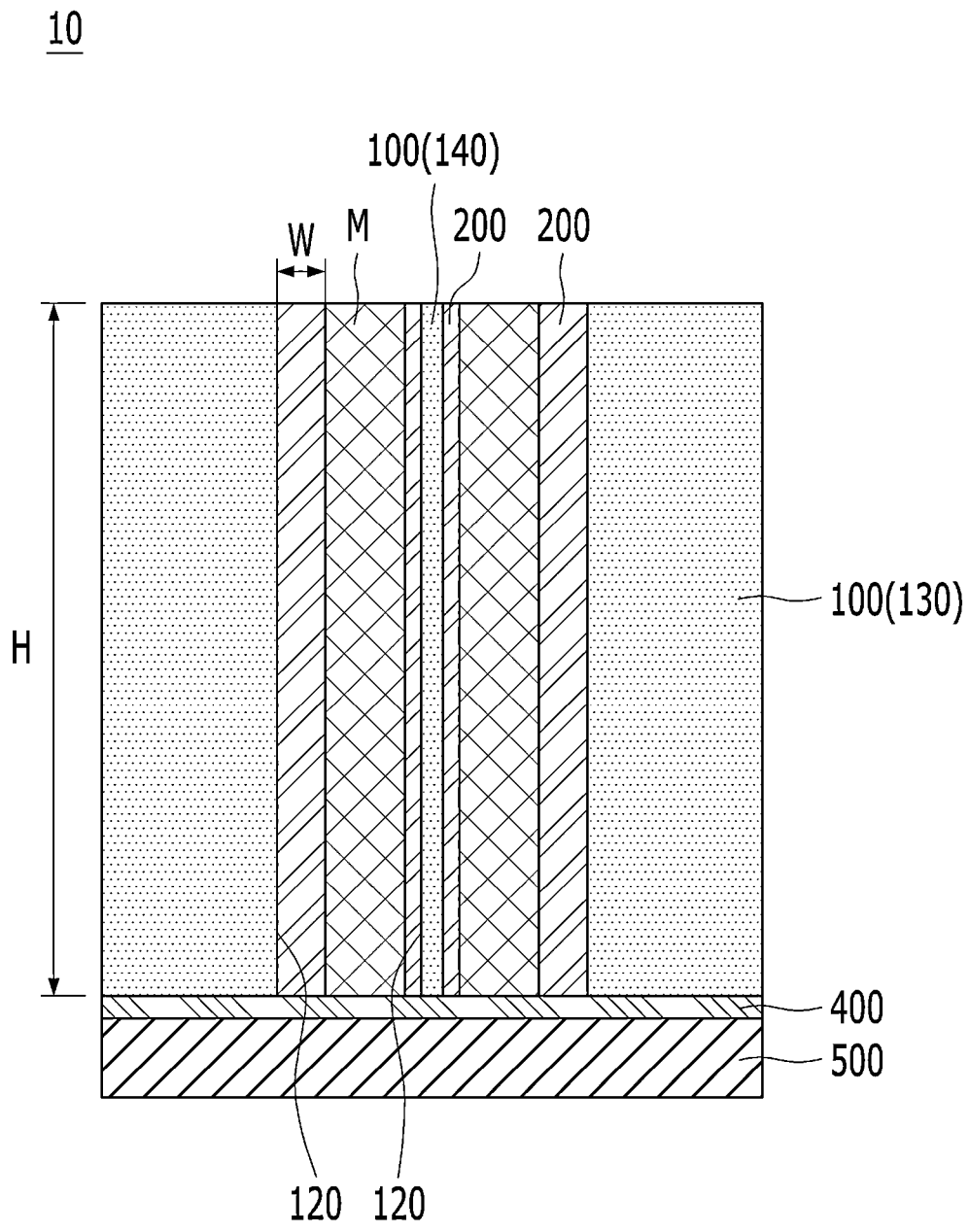
FIG. 4 is a sectional view taken along line A-A' of FIG. 3.

FIG. 1 is a plan view illustrating a mold 10 using an anodic aluminum oxide film according to an exemplary embodiment of the present disclosure. FIG. 2 is a sectional view taken along line A-A' of FIG. 1. FIG. 3 is a view illustrating a state in which a metal is filled in a space 300 of the mold 10 using the anodic aluminum oxide film according to the exemplary embodiment of the present disclosure. FIG. 4 is a sectional view taken along line A-A' of FIG. 3.

Referring to FIGS. 1 and 2, the mold 10 using the anodic aluminum oxide film includes: a support mold 100 made of the anodic aluminum oxide film and having an opening 110 and exposed wall surfaces 120 exposed toward the opening 110, and a patternable material 200 formed on the exposed wall surfaces 120 of the anodic aluminum oxide film and forming the space 300 having a smaller horizontal area than the opening 110.

The support mold 100 is made of the anodic aluminum oxide film.

The support mold 100 made of the anodic aluminum oxide film means a film formed by anodizing a metal as a base material, and pores mean holes formed in the process of forming the anodic aluminum oxide film by anodizing the metal. For example, when the metal as the base material is aluminum (Al) or an aluminum alloy, the anodization of the base material forms the anodic aluminum oxide film consisting of anodized aluminum ($Al_2O_3$) on a surface of the base material. The resulting anodic aluminum oxide film includes a barrier layer in which no pores are formed therein vertically, and a porous layer in which pores are formed therein. After removing the base material on which the anodic aluminum oxide film having the barrier layer and the porous layer is formed, only the anodic aluminum oxide film consisting of anodized aluminum ($Al_2O_3$) remains. The anodic aluminum oxide film may have a structure in which the barrier layer formed during the anodization is removed to expose the top and bottom of the pores, or a structure in which the barrier layer formed during the anodization remains to close one of the top and bottom of the pores. The anodic aluminum oxide film has a coefficient of thermal expansion of 2 to 3 ppm/° C. With this range, the anodic aluminum oxide film only undergoes a small amount of thermal deformation due to temperature when exposed to a high-temperature environment.

Figure 6A:
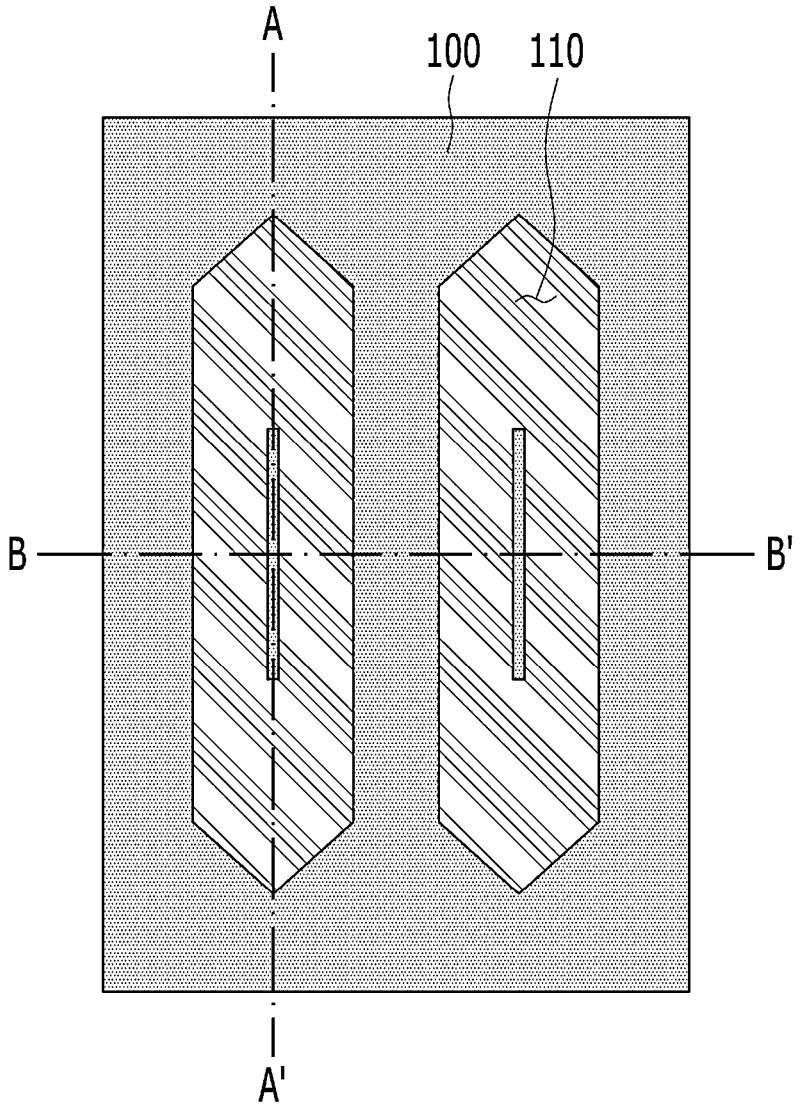
FIGS. 6A to 10C are views illustrating a method of manufacturing the metal product according to the exemplary embodiment of the present disclosure.
Figure 6B:
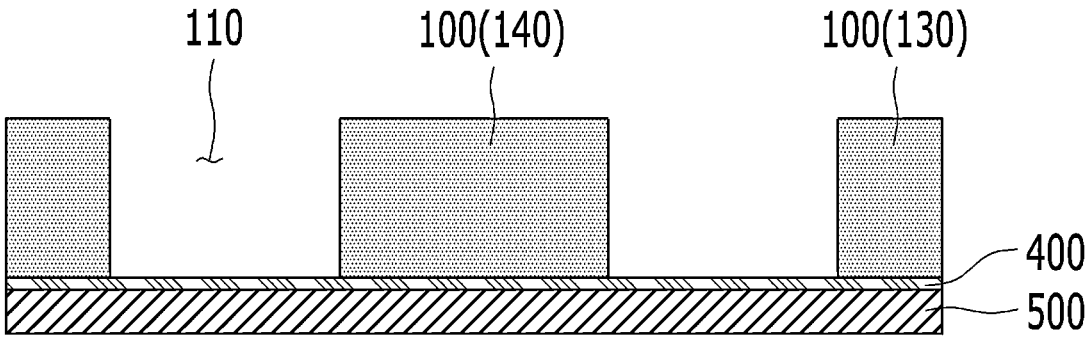
Figure 6C:
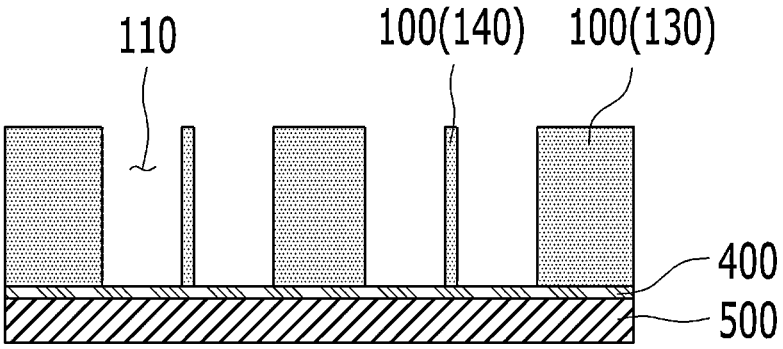

The support mold 100 has the opening 110 formed therein (see FIGS. 6A to 6C). The opening 110 is formed by vertically passing through the support mold 100. The opening 110 is formed to have a larger diameter than the pores.

The opening 110 is provided in a closed shape surrounded by the anodic aluminum oxide film except for upper and lower directions.

As the opening 110 is formed in the support mold 100, the exposed wall surfaces 120 are formed toward the opening 110. A fine uneven portion 150 is formed on the exposed wall surfaces 120. The exposed wall surfaces 120 are provided with the fine uneven portion 150 formed by the pores of the anodic aluminum oxide film. In other words, the exposed wall surfaces 120 are provided with a plurality of fine uneven portions 150 formed side by side in a long groove shape extending vertically.

The fine uneven portions 150 have a depth in the range of nm to 1 μm and a width in the range of 20 nm to 1 μm. Here, because the fine uneven portions 150 are resulted from the formation of the pores formed during the manufacture of the support mold 100 made of the anodic aluminum oxide film, the width and depth of the fine uneven portions 150 are equal to or less than the diameter of the pores formed in the support mold 100 made of the anodic aluminum oxide film. Meanwhile, in the process of forming the opening 110 in the support mold 100 made of the anodic aluminum oxide film, portions of the pores of the support mold 100 made of the anodic aluminum oxide film may be crushed by an etchant to at least partially form a fine uneven portion 150 having a depth greater than the diameter of the pores formed during the anodization. The fine uneven portions 150 as described above can contribute to increasing the surface area of the exposed wall surfaces 120. Due to the configuration of the fine uneven portions 150 of the exposed wall surfaces 120, the patternable material 200 can maintain high bonding strength with the exposed wall surfaces 120 during a manufacturing process of a metal product M.

The patternable material 200 is formed on the exposed wall surfaces 120 of the anodic aluminum oxide film. The patternable material 200 may be a photosensitive material capable of undergoing exposure and development processes. The patternable material 200 may be a photosensitive resin, and more preferably includes a photoresist.

The support mold 100 made of the anodic aluminum oxide film has higher rigidity than the patternable material 200.

In a case where only a photoresist is used as a mold, when the aspect ratio of the photoresist is large, the photoresist is deformed and cannot faithfully perform its function as a mold. On the contrary, as in the exemplary embodiment of the present disclosure, since the anodic aluminum oxide film performs a structural support role for the photoresist, it is possible to manufacture a metal product with high reliability even when the aspect ratio of the photoresist is large.

The patternable material 200 is formed at the same height as a height H of the support mold 100. In addition, the patternable material 200 has a width W and is formed along the exposed wall surfaces 120. The support mold 100 may have a height in the range of 10 μm to 200 μm. The patternable material 200 may have a width W in the range of 1 μm to 100 μm.

The patternable material 200 covers exposed wall surfaces 120 of the support mold 100 so that the exposed wall surfaces 120 are not exposed toward the space 300.

Since a part of the opening 110 is filled with the patternable material 200, the horizontal area of the space 300 is smaller than that of the opening 110. In other words, since the patternable material 200 fills a part of the horizontal area of the opening 110, the horizontal area of the space 300 formed without filling the patternable material 200 is smaller than that of the opening 110.

The support mold 100 includes a main body 130 provided around the opening 110 and an island 140 provided inside the opening 110 and spaced apart from the main body 130. The island 140 is spaced apart from the main body 130 and is completely surrounded by the opening 110.

The patternable material 200 covers exposed wall surfaces 120 of the main body 130 exposed toward the opening 110 and exposed wall surfaces 120 of the island 140 exposed toward the opening 110. As a result, the exposed wall surfaces 120 of the support mold 100 are not exposed toward the space 300.

The patternable material 200 entirely covers the exposed wall surfaces 120 of the main body 130 exposed toward the opening 110 and determines the outer perimeter of the space 300. In this case, the main body 130 provided outside the patternable material 200 serves to support the patternable material 200.

In addition, the patternable material 200 entirely covers the exposed wall surfaces 120 of the island 140 exposed toward the opening 110 and determines the inner perimeter of the space 300. In this case, the island 140 provided inside the patternable material 200 serves to support the patternable material 200.

Outside the space 300, the patternable material 200 surrounding the space 300 is provided, and the main body 130 surrounding the patternable material 200 is provided. In addition, inside the space 300, the patternable material 200 surrounded by the space 300 is provided, and the island 140 surrounded by the patternable material 200 is provided.

The space between the space 300 and the opening 110 determines the width of the patternable material 200, and the patternable material 200 determines the shape of the space 300. The shape of the space 300 determines the shape of the metal product M. The horizontal cross-sectional shape of the space 300 may be a similar figure to the horizontal cross-sectional shape of the opening 110, but is not limited thereto. The horizontal cross-sectional shape of the space 300 and the horizontal cross-sectional shape of the metal product M are the same, but the horizontal cross-sectional shape of the opening 110 is not similar to the horizontal cross-sectional shape of the metal product M.

Since the patternable material 200 formed by patterning determines the shape of the space 300, even when the shape precision of the opening 110 formed by partially removing the support mold 100 is not high, the shape precision of the space 300 can be increased by precisely patterning the patternable material 200. In addition, even in a case where the patternable material 200 has to be manufactured with a high aspect ratio, the high aspect ratio of the patternable material 200 can be maintained as the support mold 100 support side surfaces of the patternable material 200.

The mold 10 using the anodic aluminum oxide film includes a seed layer 400 provided under the space 300 and a substrate 500 provided under the seed layer 400. Here, the space 300 serves as a space for plating.

The seed layer 400 is preferably made of copper (Cu), platinum (Pt), tantalum (Ta), titanium (Ti), or an alloy of these metals, but is not limited thereto as long as it is a material that functions as a seed layer for electroplating.

Referring to FIGS. 3 and 4, a metal is formed in the space 300 to manufacture the metal product M.

Outside the metal product M, the patternable material 200 surrounding the metal product M is provided, and the main body 130 surrounding the patternable material 200 is provided. In addition, inside the metal product M, the patternable material 200 surrounded by the metal product M is provided, and the island 140 surrounded by the patternable material 200 is provided.

When forming the metal in the space 300, the metal is provided in contact with the patternable material 200. Even when pressure is applied to the patternable material 200 in the transverse direction, deformation of the patternable material 200 can be minimized by the metal, thereby maintaining the shape precision of the metal product M.

Since the metal product M is manufactured using the space 300 determined by the patternable material 200, defective areas such as cracks and damage exist on the exposed wall surfaces 120 of the support mold 100 made of the anodic aluminum oxide film, a good quality metal product M can be obtained.

In order to obtain more metal products M from a unit substrate, the pitch between the metal products M has to be narrow. According to the present disclosure, high rigidity is secured by the main body 130, which has higher rigidity than the patternable material 200, so it is possible to further narrow the pitch between the metal products M compared to constituting a mold only with a photoresist film. As a result, more metal products M can be obtained from the unit substrate. In addition, with the configuration of the island 140, it is possible to implement a slot S with a high aspect ratio compared to constituting a mold only with a photoresist film without the island 140.

The metal product M is formed by electroplating using the seed layer 400. The metal product M may be provided by stacking a plurality of metal layers.

The plurality of metal layers include a first metal layer and a second metal layer made of different materials. The first metal layer is a metal having relatively high wear resistance compared to the second metal layer, and may be a metal selected from the group consisting of rhodium (Rh), platinum (Pt), iridium (Ir), palladium (Pd), Nickel (Ni), manganese (Mn), tungsten (W), phosphorus (Ph), and an alloy of these metals; the group consisting of a palladium-cobalt (PdCo) alloy and a palladium-nickel (PdNi) alloy; or the group consisting of a nickel-phosphor (NiPh) alloy, a nickel-manganese (NiMn), a nickel-cobalt (NiCo), and a nickel-tungsten (NiW) alloy. The second metal layer is a metal having relatively high electrical conductivity compared to the first metal layer, and may be a metal selected from the group consisting of copper (Cu), silver (Ag), gold (Au), and an alloy of these metals. However, the present disclosure is not limited thereto.

Figure 5:
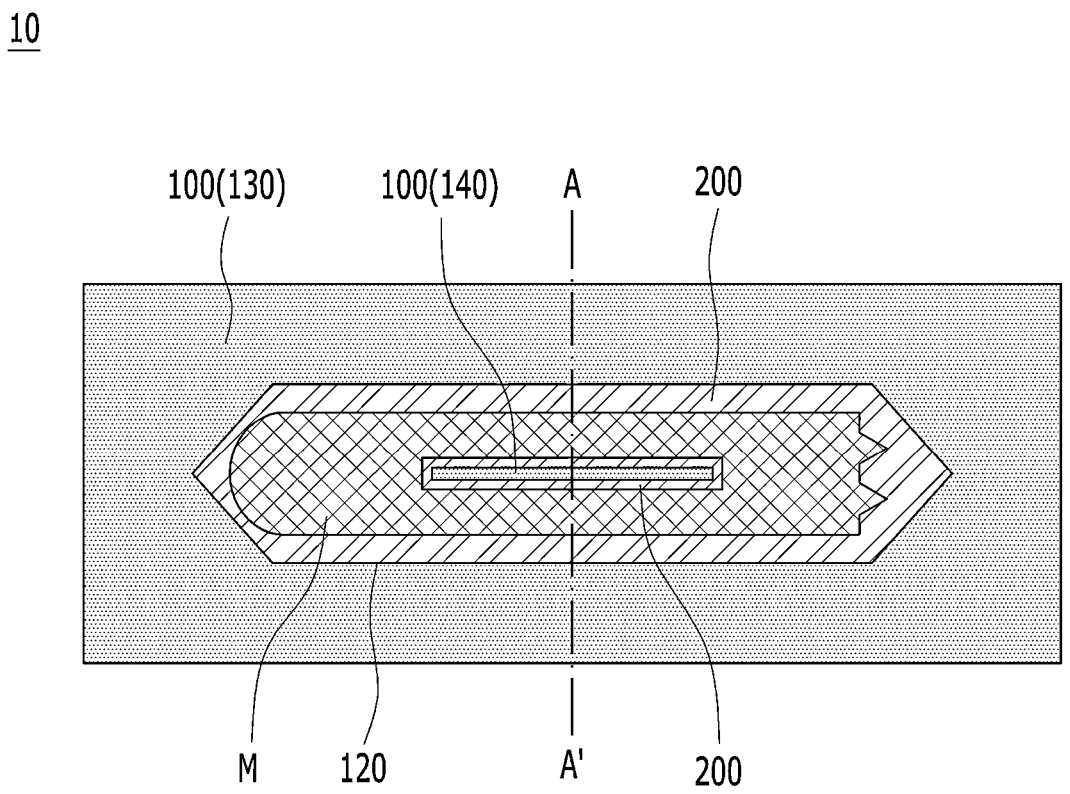
FIG. 5 is a view illustrating a state in which a metal is filled in a space of a mold using an anodic aluminum oxide film according to a modified example of the exemplary embodiment of the present disclosure.

FIG. 5 is a view illustrating a state in which a metal is filled in a space 300 of a mold 100 using an anodic aluminum oxide film according to a modified example of the exemplary embodiment of the present disclosure.

Referring to FIG. 5, the horizontal cross-sectional shape of the space 300 is not a similar figure to the horizontal cross-sectional shape of an opening 110. As described above, the opening 110 functions to provide a space filled with the patternable material 200, and the space 300, which has a boundary determined by the patternable material 200, functions to determine the shape of the metal product M.

Method of Manufacturing Metal Product M

Hereinafter, a method of manufacturing a metal product M will be described. The metal product M is manufactured using a mold 10 using an anodic aluminum oxide film.

FIGS. 6A to 10C are views illustrating the method of manufacturing the metal product M according to the exemplary embodiment of the present disclosure.

The method of manufacturing the metal product M includes: preparing a support mold 100 made of an anodic aluminum oxide film and having an opening 110; forming a patternable material 200 on exposed wall surfaces 120 of the anodic aluminum oxide film exposed toward the opening 110 to form a space 300 having a smaller horizontal area than the opening 110; and forming a metal in the space 300.

First, the support mold 100 made of the anodic aluminum oxide film and having the opening 110 is prepared.

FIG. 6A is a plan view illustrating the mold 10 in which the opening 110 is formed, FIG. 6B is a sectional view taken along line A-A' of FIG. 6A, and FIG. 6C is a sectional view taken along line B-B' of FIG. 6A.

The support mold 100 has the opening 110 formed therein. The support mold 100 is made of the anodic aluminum oxide film.

The anodic aluminum oxide film means a film formed by anodizing a metal as a base material, and pores mean holes formed in the process of forming the anodic aluminum oxide film by anodizing the metal. For example, when the metal as the base material is aluminum (Al) or an aluminum alloy, the anodization of the base material forms the anodic aluminum oxide film consisting of anodized aluminum ($Al_2O_3$) on a surface of the base material. However, the metal as the base material is not limited thereto, and includes Ta, Nb, Ti, Zr, Hf, Zn, W, Sb, or an alloy of these metals. The resulting anodic aluminum oxide film includes a barrier layer in which no pores are formed therein vertically, and a porous layer in which pores are formed therein. After removing the base material on which the anodic aluminum oxide film having the barrier layer and the porous layer is formed, only the anodic aluminum oxide film consisting of anodized aluminum ($Al_2O_3$) remains. The anodic aluminum oxide film may have a structure in which the barrier layer formed during the anodization is removed to expose the top and bottom of the pores, or a structure in which the barrier layer formed during the anodization remains to close one of the top and bottom of the pores.

A seed layer 400 is provided under the support mold 100, and a substrate 500 is provided under the seed layer 400.

The opening 110 is provided in the support mold 100.

The opening 110 may be formed by removing at least a part of the support mold 100 made of the anodic aluminum oxide film. The opening 110 may be formed by etching the support mold 100 made of the anodic aluminum oxide film. To this end, a photoresist may be provided on an upper surface of the support mold 100 made of the anodic aluminum oxide film and patterned, and then the anodic aluminum oxide film in a patterned and open area may react with an etchant to form the opening 110. In detail, a photosensitive material may be provided on the upper surface of the support mold 100 made of the anodic aluminum oxide film in a state before the opening 110 is formed, and then subjected to exposure and development processes. At least a part of the photosensitive material may be patterned and removed through the exposure and development processes to form an open area. The support mold 100 made of the anodic aluminum oxide film is subjected to an etching process in the open area from which the at least the part of the photosensitive material has been removed by patterning, thereby forming the opening 110. In addition, when the support mold 100 made of the anodic aluminum oxide film is subjected to wet etching with an etchant, an opening 110 having vertical exposed wall surfaces is formed.

The support mold 100 includes a main body 130 provided around the opening 110 and an island 140 provided inside the opening 110 and spaced apart from the main body 130. The island 140 is formed to be spaced apart from the main body 130.

Next, the patternable material 200 is formed on the exposed wall surfaces 120 of the anodic aluminum oxide film exposed toward the opening 110 to form the space 300 having a smaller horizontal area than the opening 110. This step includes filling the opening 110 with the patternable material 200, and removing a part of the patternable material 200 filled in the opening 110 so that the space 300 is formed inside the patternable material 200 while the exposed wall surfaces 120 are covered by the patternable material 200 so as not to be exposed toward the space 300.

First, the opening 110 is filled with the patternable material 200.

Figure 7A:
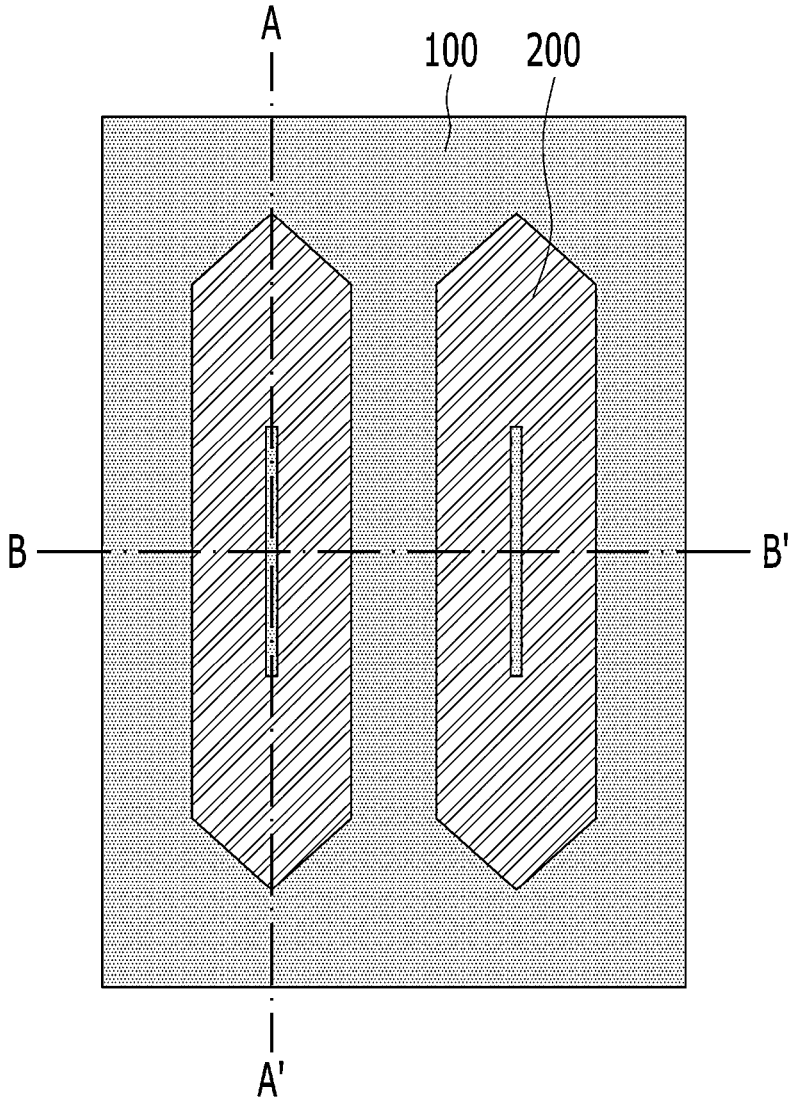
Figure 7B:
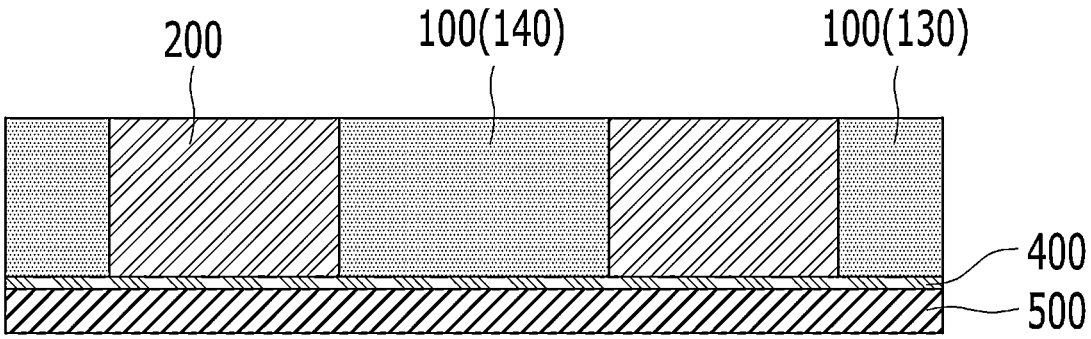
Figure 7C:
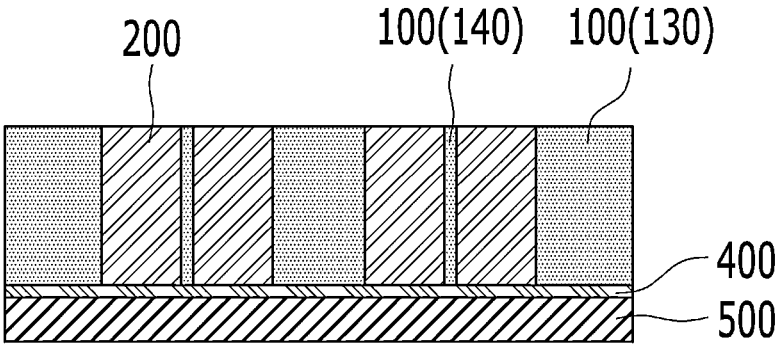

FIG. 7A is a plan view illustrating the mold 10 in which the opening 110 is filled with the patternable material 200, FIG. 7B is a sectional view taken along the line A-A' of FIG. 7A, and FIG. 7C is a sectional view taken along the line B-B' of FIG. 7A.

The patternable material 200 may be a photosensitive material capable of undergoing exposure and development processes. The patternable material 200 includes a photoresist. In this case, the patternable material 200 protruding from an upper surface of the support mold 100 made of the anodic aluminum oxide film may be removed and planarized through a chemical mechanical polishing (CMP) process.

Next, the part of the patternable material 200 filled in the opening 110 is removed so that the space 300 is formed inside the patternable material 200 while the exposed wall surfaces 120 are covered by the patternable material 200 so as not to be exposed toward the space 300.

Figure 8A:
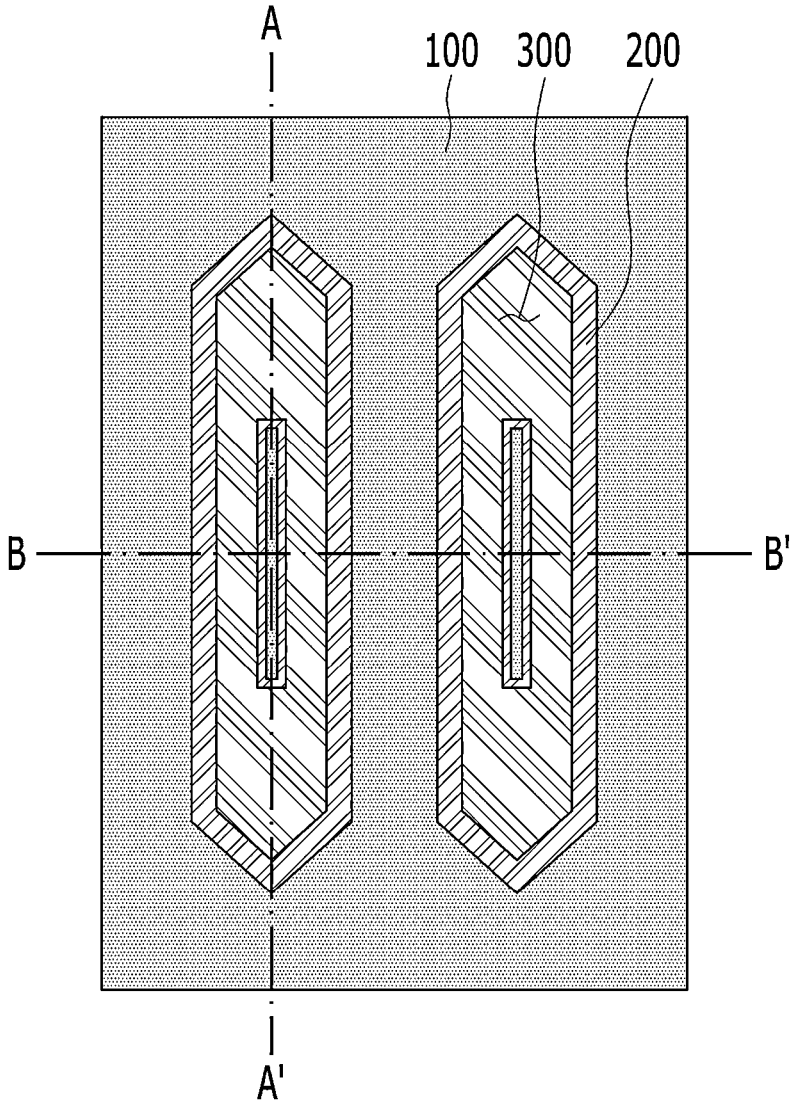
Figure 8B:
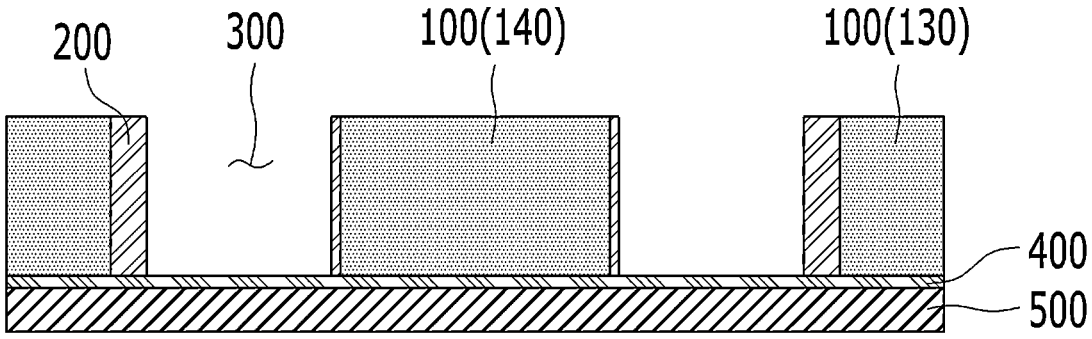
Figure 8C:
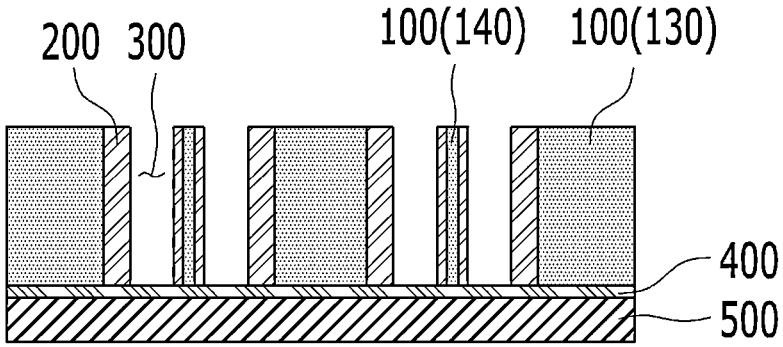

FIG. 8A is a plan view illustrating the mold 10 in which the part of the patternable material 200 is removed to form the space 300, FIG. 8B is a sectional view taken along line A-A' of FIG. 8A, and FIG. 8C is a sectional view taken along line B-B' of FIG. 8A.

The patternable material 200 covers exposed wall surfaces 120 of the main body 130 exposed toward the opening 110 and exposed wall surfaces 120 of the island 140 exposed toward the opening 110. Due to the patternable material 200, the exposed wall surfaces 120 of the main body 130 and the exposed wall surfaces 120 of the island 140 are not exposed toward the space 300. Only the patternable material 200 is exposed toward the space 300.

Next, the metal is formed in the space 300.

Figure 9A:
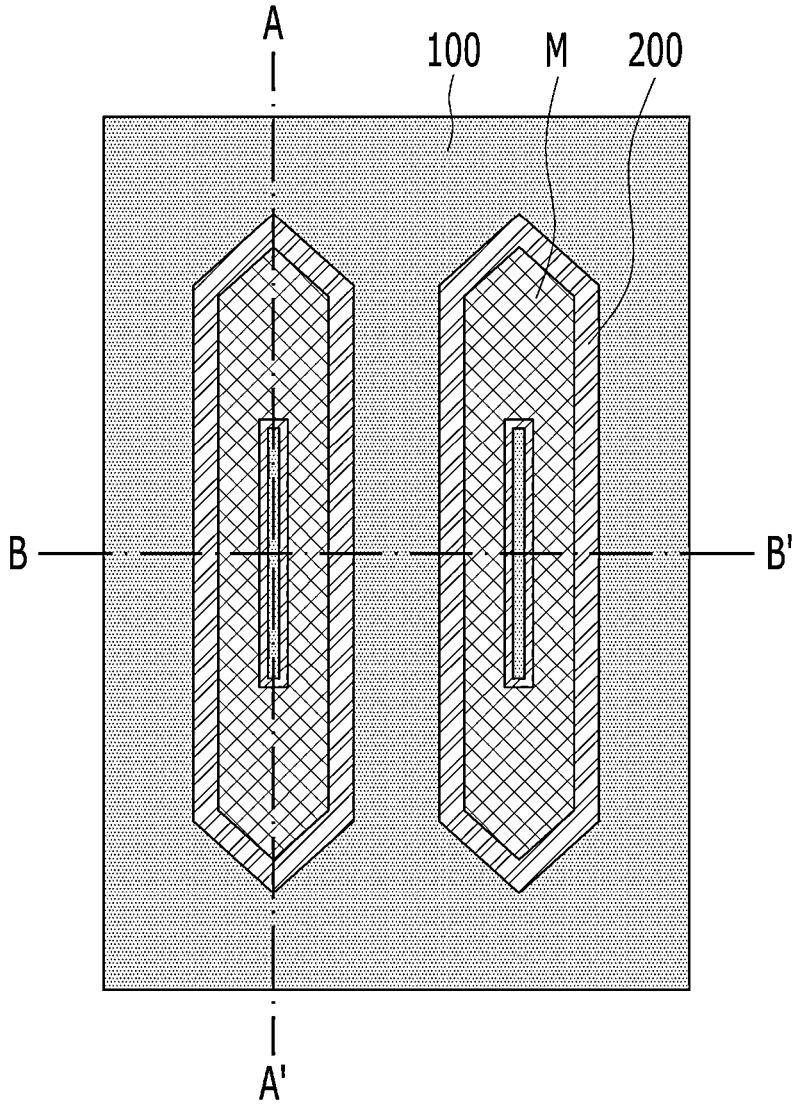
Figure 9B:
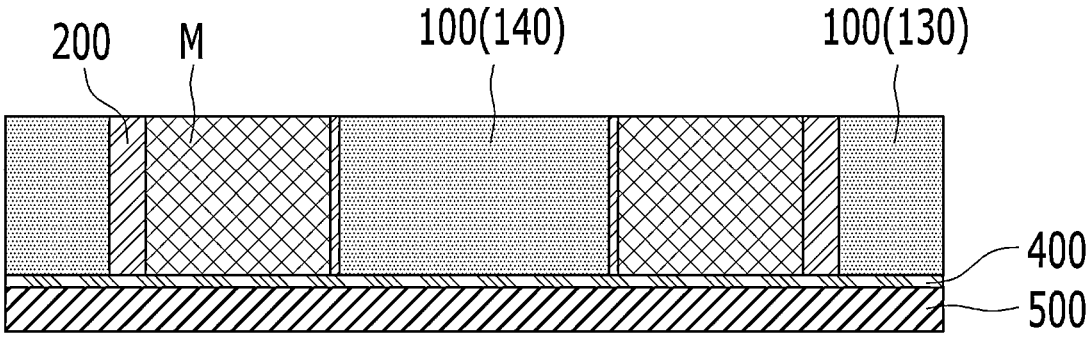
Figure 9C:
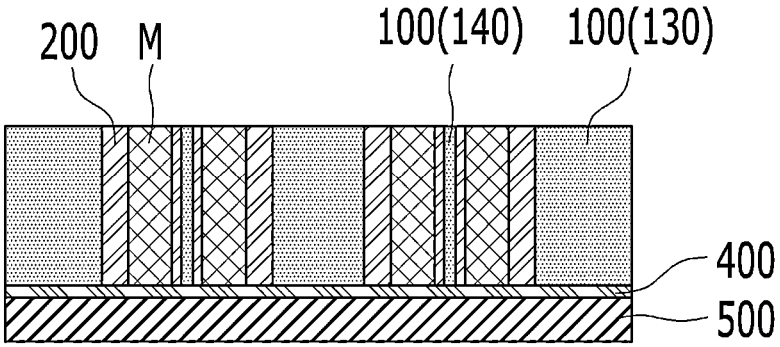

FIG. 9A is a plan view illustrating the mold 10 in which the metal is formed in the space 300, FIG. 9B is a sectional view taken along line A-A' of FIG. 9A, and FIG. 9C is a sectional view taken along line B-B' of FIG. 9A.

The metal product M is formed by electroplating using the seed layer 400. The metal product M may be provided by stacking a plurality of metal layers. The metal product M is only in contact with the patternable material 200 on side surfaces thereof and is not in contact with the support mold 100.

Next, the support mold 100 and the patternable material 200 are removed.

Figure 10A:
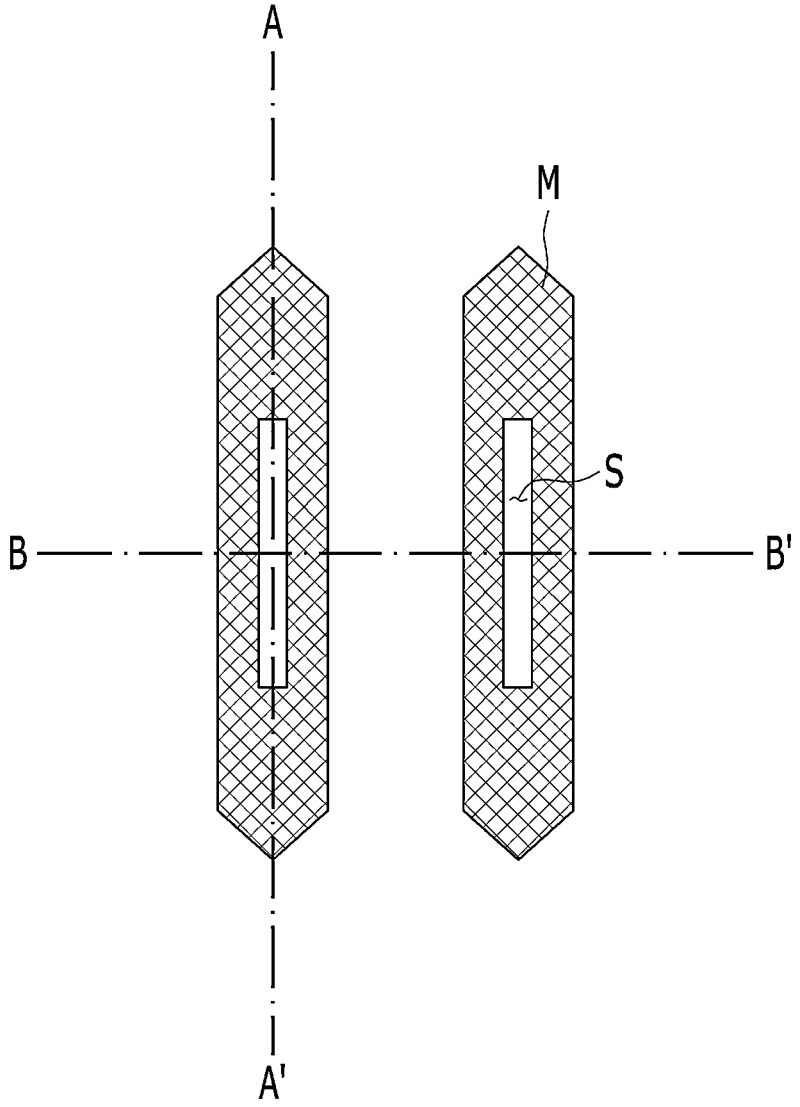
Figure 10B:
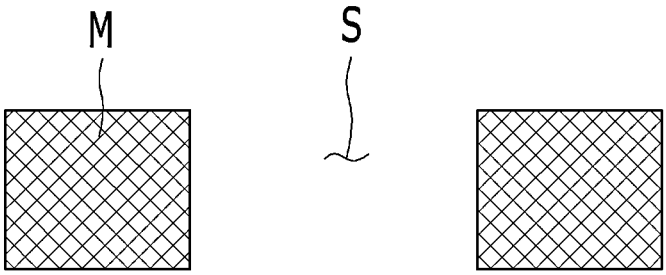
Figure 10C:
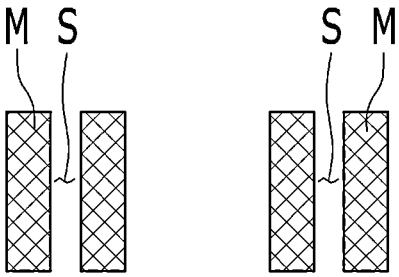

FIG. 10A is a plan view illustrating the metal product M, FIG. 10B is a sectional view taken along line A-A' of FIG. 10A, and FIG. 10C is a sectional view taken along line B-B' of FIG. 10A.

The seed layer 400 and the substrate 500 are also removed. The patternable material 200 is removed using a material that only reacts with the patternable material 200. In addition, the seed layer 400 is removed using a material that reacts only with the seed layer 400. In addition, the support mold 100 is removed using a material that only reacts with the anodic aluminum oxide film. As a result, only the metal-plated metal product M is obtained.

In this case, the island 140 and the patternable material 200 surrounding the island 140 are removed to form a slot S. As a result, the metal product M is provided with the slot S therein. In order to implement the slot S using only a photoresist without the island 140 made of the anodic aluminum oxide film, the photoresist in the area corresponding to the slot S has to have a high aspect ratio. In this case, the photoresist has a problem of not maintaining its deformation due to the high aspect ratio. However, as in the exemplary embodiment of the present disclosure, the shape of the patternable material 200 can be maintained by configuration of the island 140 made of the anodic aluminum oxide film, making it possible to easily implement the slot S with a high aspect ratio.

The metal product M described above may be an electrically conductive contact pin provided in a probe card to inspect a semiconductor chip, or may be an electrically conductive contact pin provided in a test socket for inspecting a semiconductor package and inspecting the semiconductor package. In addition, any metal product that is used to check whether an inspection object is defective by applying electricity is included.

However, the metal product M that can be manufactured using the mold 10 according to the exemplary embodiment of the present disclosure is not limited thereto.

Although the exemplary embodiments of the present disclosure have been described for illustrative purposes, those skilled in the art will appreciate that various modifications, additions, and substitutions are possible, without departing from the scope and spirit of the present disclosure as disclosed in the accompanying claims.

What is claimed is:

1. A mold using an anodic aluminum oxide film, the mold comprising:

a support mold made of the anodic aluminum oxide film and having an opening and exposed wall surfaces exposed toward the opening; and a patternable material formed on the exposed wall surfaces of the anodic aluminum oxide film and forming a space having a smaller horizontal area than the opening, wherein the patternable material is a photosensitive material.

2. The mold of claim 1, wherein the patternable material is formed at the same height as a height of the support mold, and the patternable material has a width and is formed along the exposed wall surfaces.

3. The mold of claim 1, wherein the patternable material covers the exposed wall surfaces of the support mold so that the exposed wall surfaces are not exposed toward the space.

4. The mold of claim 1, wherein the support mold comprises:

a main body provided around the opening; and an island provided inside the opening and spaced apart from the main body, wherein the patternable material covers exposed wall surfaces of the main body exposed toward the opening and exposed wall surfaces of the island exposed toward the opening.

5. The mold of claim 1, further comprising:

a seed layer provided under the space; and a substrate provided under the seed layer, wherein the space serves as a space for plating.

6. A method of manufacturing a metal product, the method comprising:

preparing a support mold made of an anodic aluminum oxide film and having an opening;

forming a patternable material on exposed wall surfaces of the anodic aluminum oxide film exposed toward the opening to form a space having a smaller horizontal area than the opening; and forming a metal in the space, wherein the patternable material is a photosensitive material.

7. The method of claim 6, wherein the forming of the patternable material comprises:

filling the opening with the patternable material; and removing a part of the patternable material filled in the opening so that the space is formed inside the patternable material while the exposed wall surfaces are covered by the patternable material so as not to be exposed toward the space.

8. The method of claim 6, further comprising:

after the forming of the metal in the space, removing the support mold and the patternable material.

* * * * *